US006962005B1

(12) United States Patent
Khosropour et al.

(10) Patent No.: US 6,962,005 B1
(45) Date of Patent: Nov. 8, 2005

(54) DRYER SYSTEM FOR SHOWER

(75) Inventors: Michael Khosropour, Madison, WI (US); Harold Leung, Daly City, CA (US); Jim R. Pauls, Concord, CA (US); Bob A. Davis, Napa, CA (US)

(73) Assignee: Jacuzzi, Inc., West Palm Beach, FL (US)

( * ) Notice: Subject to any disclaimer, the term of this patent is extended or adjusted under 35 U.S.C. 154(b) by 30 days.

(21) Appl. No.: 10/918,763

(22) Filed: Aug. 13, 2004

Related U.S. Application Data

(60) Provisional application No. 60/535,854, filed on Jan. 12, 2004.

(51) Int. Cl.[7] ..... F26B 19/00

(52) U.S. Cl. ..... 34/218; 34/232; 34/233; 34/235; 34/90; 34/546; 34/554; 392/381; 4/598

(58) Field of Search ..... 34/202, 218, 232, 34/233, 234, 235, 90, 546, 554; 392/379, 392/380, 381; 4/596, 597, 598

(56) References Cited

U.S. PATENT DOCUMENTS

| | | | | |
|---|---|---|---|---|
| 3,128,161 A | | 4/1964 | Hudon | |
| 3,587,118 A | * | 6/1971 | Compton | 4/597 |
| 3,781,921 A | * | 1/1974 | Rouat | 34/91 |
| 3,878,621 A | | 4/1975 | Duerre | |
| 4,558,526 A | | 12/1985 | Baus | |
| 4,685,222 A | | 8/1987 | Houck, Jr. | |
| 4,733,421 A | | 3/1988 | Kuersteiner | |
| 4,780,595 A | | 10/1988 | Alban | |
| 4,857,705 A | | 8/1989 | Blevins | |
| 4,961,272 A | * | 10/1990 | Lee | 34/90 |
| 5,099,587 A | | 3/1992 | Jarosch | |
| 5,269,071 A | * | 12/1993 | Hamabe et al. | 34/554 |
| 5,377,424 A | | 1/1995 | Albanes | |
| 5,873,179 A | | 2/1999 | Gregory et al. | |
| 6,148,539 A | * | 11/2000 | Hatfield et al. | 34/223 |
| 6,681,417 B2 | * | 1/2004 | Brunelle et al. | 4/597 |

FOREIGN PATENT DOCUMENTS

EP 0505116 A2 9/1992

* cited by examiner

*Primary Examiner*—Jiping Lu
(74) *Attorney, Agent, or Firm*—Thomas R. Lampe

(57) ABSTRACT

A shower dryer system includes a dryer tower with nozzles for directing heated air into a shower enclosure interior. A programmed controller controls the rate of air flow and the temperature of air flow to and through the air nozzles.

7 Claims, 3 Drawing Sheets

DRYER SYSTEM FOR SHOWER

This application is based on and claims the benefit of U.S. Provisional Patent Application No. 60/535,854, filed on Jan. 12, 2004.

TECHNICAL FIELD

This invention relates to a dryer system for drying the interior of a shower enclosure and a person in the interior.

BACKGROUND OF THE INVENTION

It is known to provide arrangements for drying and heating shower stalls before taking a shower. Such devices are also employed by a user who would like to be able to dry himself of herself after the shower.

The typical prior art arrangement allows air to come in from the wall or from a duct on top of the shower. Such arrangements do not do an effective job and they are quite costly to install. Furthermore, maintenance of wall mounted and ceiling mounted installations is difficult and costly.

It is also known to direct heated air toward a person in a shower or other confined space to facilitate drying. Some of these devices have a tower-like configuration and define heated air exits (slots or holes) along the lengths thereof.

The following patent publications are believed to be representative of the current state of the prior art in this field: U.S. Pat. No. 5,099,587, issued Mar. 31, 1992, U.S. Pat. No. 4,733,421, issued Mar. 29, 1988, U.S. Pat. No. 4,558,526, issued Dec. 17, 1985, U.S. Pat. No. 3,128,161, issued Apr. 7, 1964, U.S. Pat. No. 4,685,222, issued Aug. 11, 1987, U.S. Pat. No. 5,377,424, issued Jan. 3, 1995, U.S. Pat. No. 3,878,621, issued Apr. 22, 1975, U.S. Pat. No. 4,780,595, issued Oct. 25, 1988, U.S. Pat. No. 4,857,705, issued Aug. 15, 1989, U.S. Pat. No. 5,873,179, issued Feb. 23, 1999 and European Patent Application No. 9230221301.

The invention disclosed and claimed herein differs from the prior art in a number of respects, differences which contribute to the improved operation and ease of maintenance of the system.

DISCLOSURE OF INVENTION

The present invention relates to a dryer system for drying the interior of a shower enclosure and a person in the interior.

The dryer system includes a dryer tower including a plurality of spaced air nozzles for directing air into the interior of the shower enclosure. Also incorporated in the system is an air blower. Conduit structure provides air flow communication between the air nozzles and the air blower.

A heater is provided for heating flowing air produced by the air blower prior to exit of the flowing air from the nozzles into the interior of the shower enclosure.

The invention incorporates a drying tower which can be installed independently of any shower wall or base or ceiling. If desired, the drying tower may be incorporated in the shower enclosure with which it is associated.

A controller is operatively associated with the air blower and with the heater for controlling the rate of air flow to and through the air nozzles and for controlling the temperature of air flowing to and through the air nozzles. The dryer tower incorporates a touch-pad control as part of the controller. When the shower water is turned on, a flow switch initiates operation of the heater and air blower at a low flow rate for the purpose of preheating the lines, joints and nozzles of the system to provide hot air immediately after showering. By the time the shower is completed, the user can increase the flow and obtain hot air from the nozzles instantly. If the user does not plan to use the dryer, he/she can turn off the preheating mode by pushing an off button on the touch-pad control.

Other features, advantages and objects of the present invention will become apparent with reference to the following description and accompanying drawings.

BEST MODE FOR CARRYING OUT THE INVENTION

Figure 1:
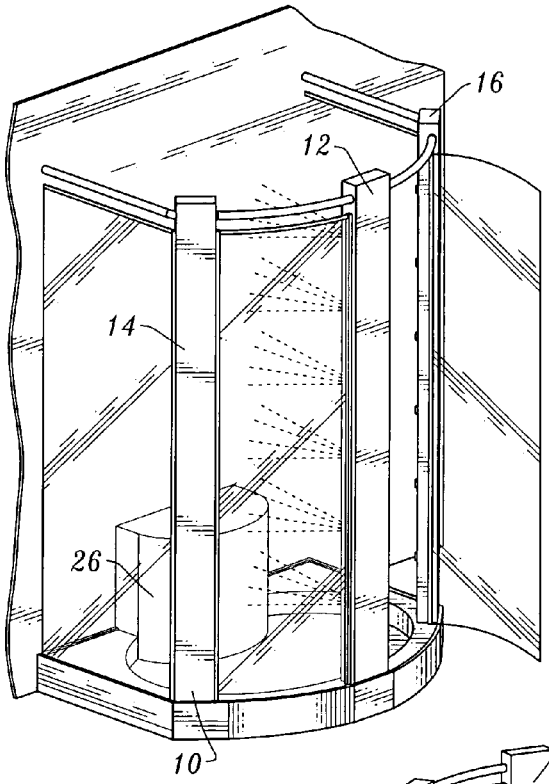
FIG. 1 is a perspective view of a shower enclosure incorporating a dryer tower constructed in accordance with the teachings of the present invention and shower towers.
Figure 2:
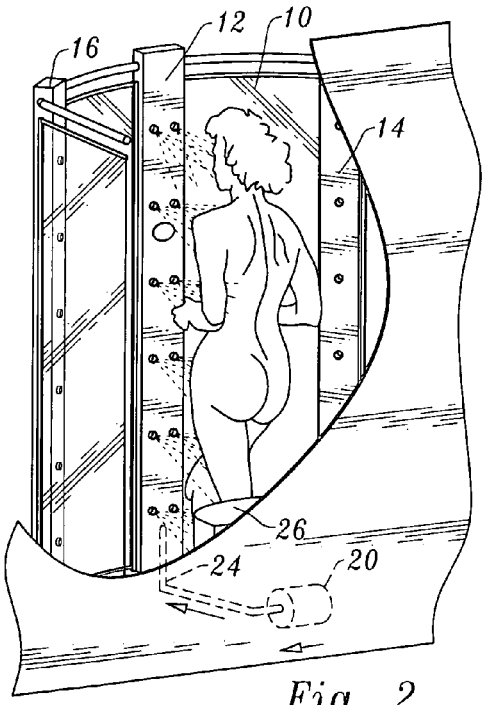
FIG. 2 is a perspective view illustrating the dryer system of the present invention drying an individual.

Referring now to the drawings, a preferred embodiment of a dryer system constructed in accordance with the teachings of the present invention is illustrated. The dryer system is for the purpose of drying the interior of a shower enclosure 10 and a person in the interior.

Figure 3:
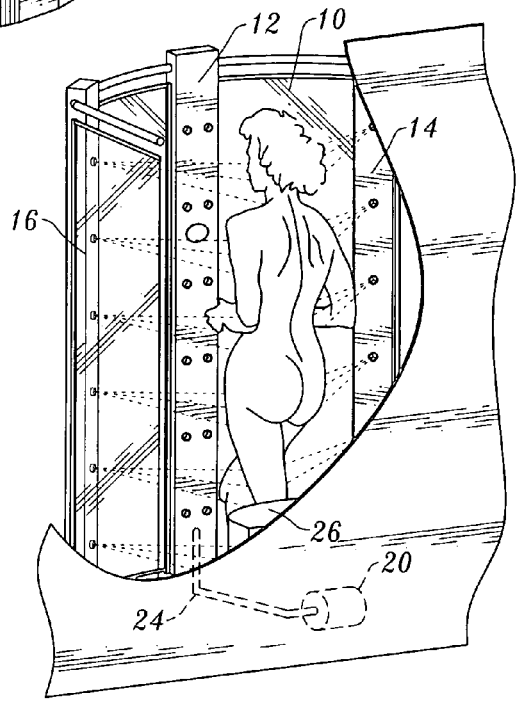
FIG. 3 is a view similar to FIG. 2, but illustrating the dryer tower in an inactive state and the individual being sprayed by water from two shower towers of the shower enclosure.
Figure 6:
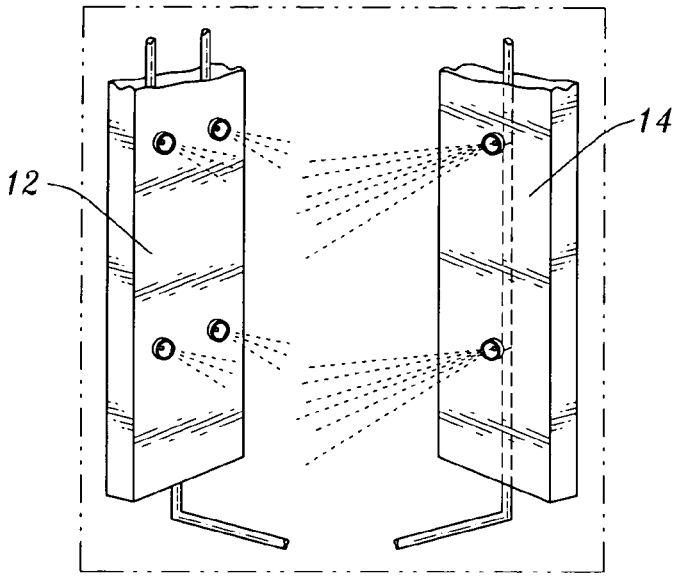
FIG. 6 is a perspective view showing portions of a dryer tower and a shower tower, the shower tower spraying water and the dryer tower emitting air at a low rate.

The dryer system includes a dryer tower 12 which in the illustrated arrangement is located between panels of the enclosure and spaced from two shower towers 14, 16 also cooperating with shower enclosure panels. The shower towers 14, 16 are of conventional construction and incorporate water nozzles along the lengths thereof for directing water toward the body of the occupant of the shower enclosure. Water flow lines, such as water flow line 18 shown in FIGS. 6 and 7 associated with shower tower 14, deliver water under pressure to the nozzles of the shower towers. FIG. 3 shows both shower towers operating and FIG. 6 shows shower tower 14 operating to deliver a spray of water.

The dryer system of this invention incorporates an air blower 20 which delivers pressurized air to air nozzles 22 of the dryer tower. This is accomplished by conduit structure 24 providing air flow communication between the air nozzles and the air blower. In the arrangement illustrated, the air blower 20 is located within a chamber defined by a seat 26 in the interior of the shower enclosure. The seat protects the air blower from water in the interior of the shower enclosure.

Air blower 20 includes an air intake 32 (see FIG. 4) which extends from a location outside the shower enclosure so that water within the interior of the shower enclosure will not reach the air blower through the air intake. For example, the distal end of the air intake may be located between wall studs adjoining the shower enclosure.

The dryer system includes a heater 34 in the dryer tower which may be any suitable conventional electrically operated heater. The heater is for heating flowing air produced by the air blower prior to exit of the flowing air from the nozzles 22 into the interior of the shower enclosure.

The conduit structure includes two vertically disposed conduits 36, 38 within the interior of the dryer tower. The conduits 36 and 38 respectively are associated with two rows of spaced air nozzles 22. The nozzles are disposed at different elevations along the dryer tower so that they are in line with different portions of a person's body. A tee 40 at the top of the dryer tower interconnects the conduits 36, 38 to the segment of the conduit structure directly connected to blower 20.

The vertically disposed conduits 36, 38 extend downwardly communicating with all of the respective air nozzles associated therewith, including a pair of bottom air nozzles. This arrangement allows any water entering the air nozzles above the two bottom air nozzles to drain downwardly through the conduits 36, 38 to and out of the bottom air nozzles into the interior of the shower enclosure. The heater 34 is disposed in the dryer tower at an elevation higher than the elevation of the bottom air nozzles, the heater heating the air flowing into the vertically disposed conduits.

Figure 4:
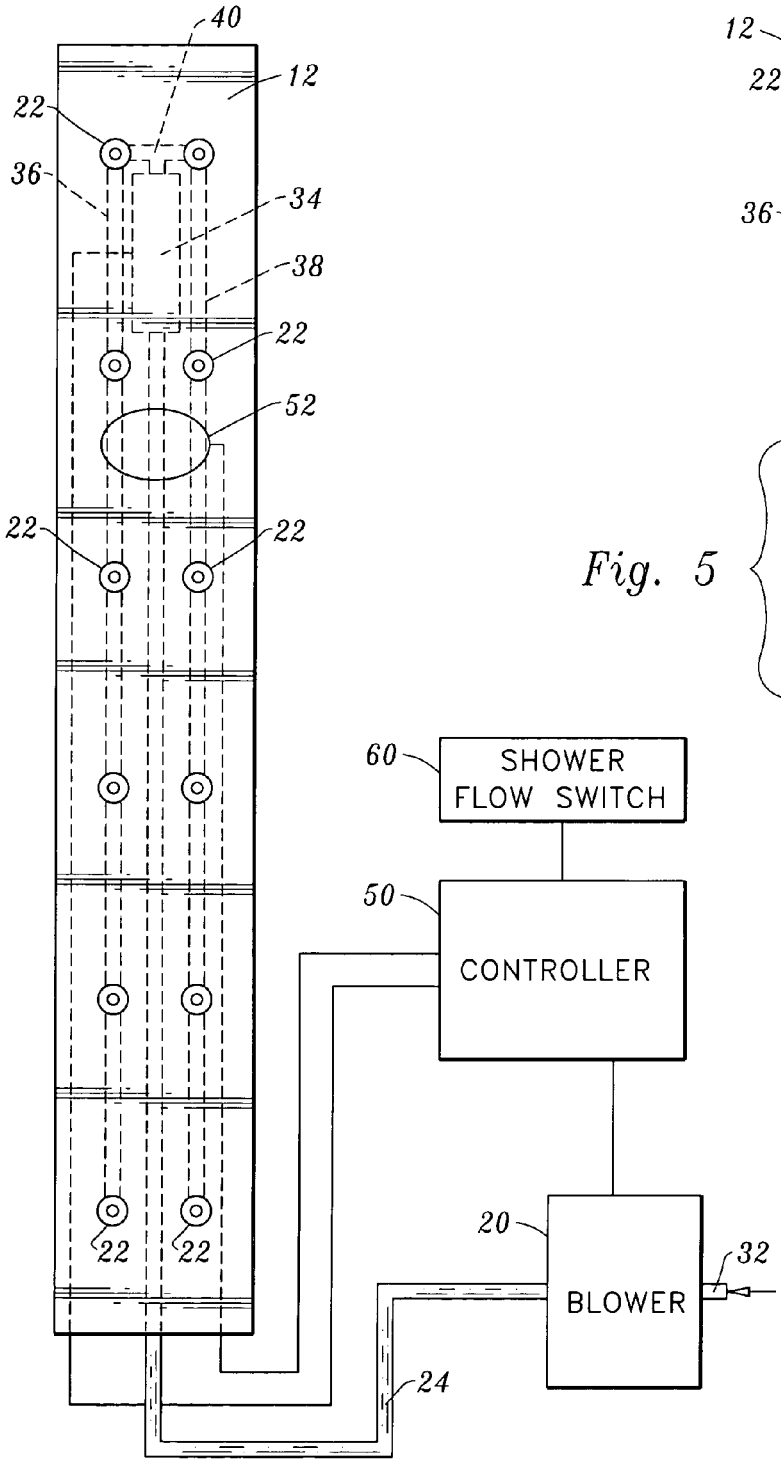
FIG. 4 is a diagrammatic view of components of the dryer system of the present invention.
Figure 5:
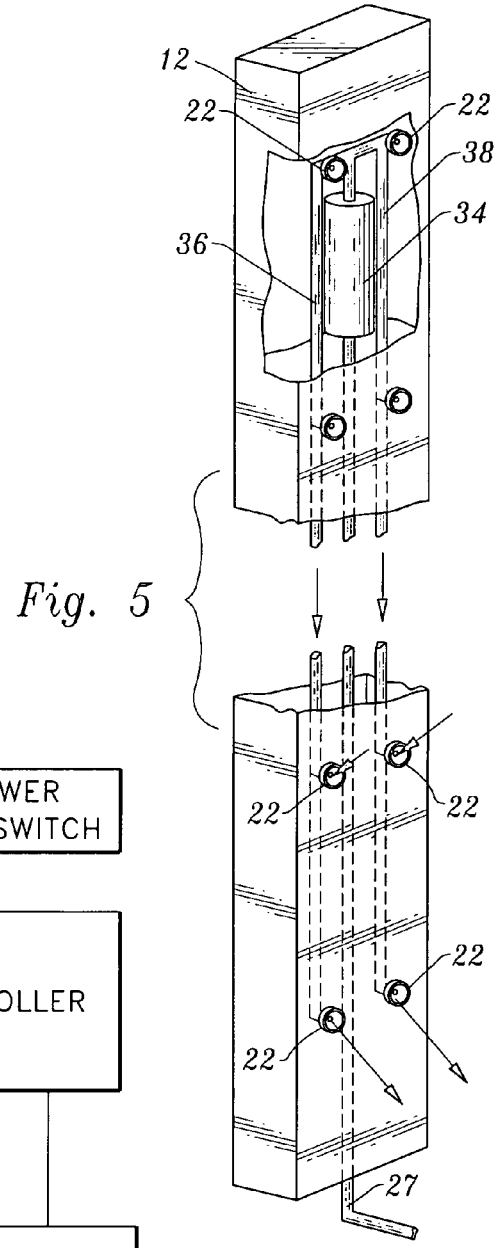
FIG. 5 is a perspective view illustrating top and bottom portions of the dryer tower of the invention along with related components including a heater for heating flowing air and illustrating by arrows drainage of water out of two bottom nozzles of the dryer tower.

As can be seen with reference to FIG. 4, the dryer system also includes a suitably programmed, microprocessor based controller 50 which incorporates and is manually actuated by a touch-pad 52 on the dryer tower 12. The controller is operatively associated with the air blower and with the heater for controlling the rate of air flow to and through the air nozzles 22 and also for controlling the temperature of the air flowing to and through the air nozzles. The touch-pad includes suitable actuator switches allowing the user to make the desired adjustments of air flow rate and air temperature. If the user does not plan to use the dryer, he or she can utilize an off button (not shown).

Figure 7:
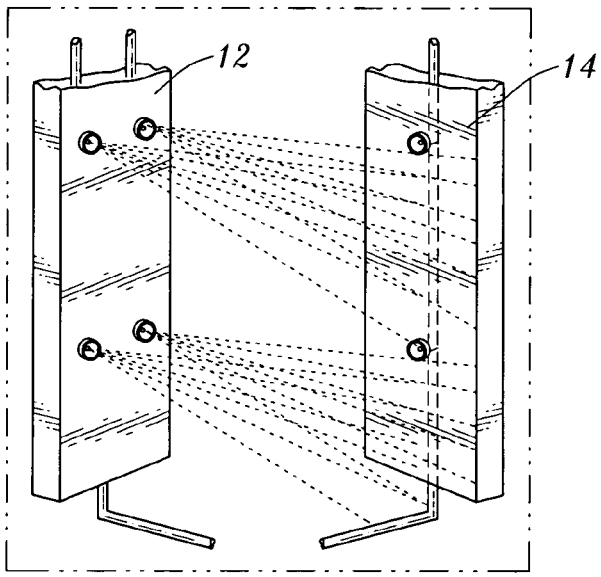
FIG. 7 is a view similar to FIG. 6, but illustrating the shower tower inactive and the air dryer tower fully active and delivering heated air at a high rate.

The system additionally comprises a water flow switch 60 (FIG. 4) which senses flow of water to one or both of the shower towers. The controller is programmed to receive a signal from the flow switch when such water flow is sensed. The controller then operates to actuate the heater and air blower to deliver hot air to the dryer tower at a low flow rate. The purpose of this is to preheat the lines, joints and nozzles of the system to enable the system to provide hot air immediately after showering. By the time the shower is completed, the user can increase the flow and get hot air out the nozzles instantly. If the user does not plan to use the drying tower, he or she can turn off the preheating mode by pushing an appropriate off button. FIG. 6 shows reduced flow of air from dryer tower 12 responsive to water flow through shower tower 14. FIG. 7 shows flow in the shower tower terminated. The controller, based on a signal from flow switch 60, will then cause the drying air to be emitted at the normal desired rate, as shown in FIG. 7.

The invention claimed is:

1. A dryer system for drying the interior of a shower enclosure and a person in said interior, said dryer system comprising, in combination:

a dryer tower including a plurality of spaced air nozzles for directing air into the interior of said shower enclosure;

an air blower;

conduit structure providing air flow communication between said air nozzles and said air blower;

a heater for heating flowing air produced by said air blower prior to exit of said flowing air from said nozzles into the interior of said shower enclosure; and a seat in the interior of said shower enclosure defining a chamber accommodating said air blower and protecting said air blower from water in the interior of said shower enclosure.

2. The dryer system according to claim 1 wherein said air blower includes an air intake extending from a location outside said shower enclosure to prevent water within the interior of said shower enclosure from reaching said air blower through said air intake.

3. A dryer system for drying the interior of a shower enclosure and a person in said interior, said dryer system comprising, in combination:

a dryer tower including a plurality of spaced air nozzles for directing air into the interior of said shower enclosure;

an air blower;

conduit structure providing air flow communication between said air nozzles and said air blower; and a heater for heating flowing air produced by said air blower prior to exit of said flowing air from said nozzles into the interior of said shower enclosure, said conduit structure including a vertically disposed conduit in said dryer tower, air nozzles of said plurality of spaced air nozzles disposed at different elevations along the dryer tower and including a bottom air nozzle, said vertically disposed conduit interconnecting the air nozzles disposed at different elevations and allowing water entering the air nozzles above said bottom air nozzle to drain downwardly to and out of said bottom air nozzle into the interior of said shower enclosure.

4. The dryer system according to claim 3 wherein said heater is disposed in said dryer tower at an elevation higher than the elevation of said bottom air nozzle, said heater heating the air flowing into said vertically disposed conduit.

5. A dryer system for drying the interior of a shower enclosure and a person in said interior, said dryer system comprising, in combination:

a dryer tower including a plurality of spaced air nozzles for directing air into the interior of said shower enclosure;

an air blower;

conduit structure providing air flow communication between said air nozzles and said air blower; and a heater for heating flowing air produced by said air blower prior to exit of said flowing air from said nozzles into the interior of said shower enclosure, said conduit structure including a plurality of vertically disposed conduits in said dryer tower, said plurality of vertically disposed conduits being in fluid flow communication, air nozzles of said plurality of spaced air nozzles disposed at different elevations along the dryer tower and including a plurality of bottom air nozzles, said plurality of vertically disposed conduits interconnecting the air nozzles disposed at different elevations and allowing water entering the air nozzles above said plurality of bottom air nozzles to drain downwardly to and out of said bottom air nozzles into the interior of said shower enclosure.

6. The dryer system according to claim 5 wherein said heater is disposed in said dryer tower at an elevation higher than the elevations of said plurality of bottom air nozzles, said heater heating the air flowing into said plurality of vertically disposed conduits.

7. A dryer system for drying the interior of a shower enclosure and a person in said interior, said dryer system comprising, in combination:

a dryer tower including a plurality of spaced air nozzles for directing air into the interior of said shower enclosure;

an air blower;

conduit structure providing air flow communication between said air nozzles and said air blower;

a heater for heating flowing air produced by said air blower prior to exit of said flowing air from said nozzles into the interior of said shower enclosure;

a controller operatively associated with said air blower and with said heater for controlling the rate of air flow to and through said air nozzles and for controlling the temperature of air flowing to and through said air nozzles; and a flow switch operatively associated with said controller, said flow switch for sensing shower water flow, and said controller responsive to said sensed water flow to actuate said air blower and heater.

* * * * *